US006182594B1

(12) United States Patent
Wilson

(10) Patent No.: US 6,182,594 B1
(45) Date of Patent: Feb. 6, 2001

(54) TOWABLE INNERTUBE ACCESSORY WITH RUDDER

(76) Inventor: Charles G. Wilson, 1940 NE. 3rd Loop, Camas, WA (US) 98607

( * ) Notice: Under 35 U.S.C. 154(b), the term of this patent shall be extended for 0 days.

(21) Appl. No.: 09/416,410

(22) Filed: Oct. 12, 1999

(51) Int. Cl.[7] ..... B63B 21/04

(52) U.S. Cl. ..... 114/253; 114/246; 114/162; 441/66; 441/67

(58) Field of Search ..... 114/345, 351, 114/253, 144 R, 246, 162; 441/65, 66, 67, 69, 79, 129, 131, 132

(56) References Cited

U.S. PATENT DOCUMENTS

| | | | | |
|---|---|---|---|---|
| 3,581,328 | * | 6/1971 | Smith | 441/67 |
| 4,213,413 | * | 7/1980 | Courtney | 114/253 |
| 5,076,189 | * | 12/1991 | Jones | 114/253 |
| 5,247,898 | * | 9/1993 | Thornlimb | 114/253 |
| 5,462,001 | * | 10/1995 | Lemelson | 114/253 |
| 5,819,680 | | 10/1998 | Haller et al. | 114/253 |
| 5,899,782 | | 5/1999 | Martin | 441/66 |

* cited by examiner

*Primary Examiner*—Stephen Avila
(74) *Attorney, Agent, or Firm*—Marger Johnson & Johnson, P.C.

(57) ABSTRACT

An innertube accessory that facilitates towing an innertube by a boat. The accessory includes a shell for receiving any size innertube and attaching it. The accessory is suitable for being towed by the boat, by a track and trolley mechanism that adapts to different towing angles away from the boat center line. The innertube rider can steer the accessory by operating a rudder. The rudder is a steering rope that controls pivoting of a rudder fin relative to the shell. Additional fins provide stability.

7 Claims, 5 Drawing Sheets

TOWABLE INNERTUBE ACCESSORY WITH RUDDER

BACKGROUND OF THE INVENTION

1. Field of the Invention

The present invention is related to the field of water sports, and more specifically to watercraft of the type towed behind a boat or other vessel.

2. Description of the Related Art

A fun water sport is to be towed behind a boat on an innertube, that is also known as a ski biscuit. A rider sits in the innertube, which is attached to a speeding boat by a towline, and thus gets pulled wherever the boat goes.

A problem with this sport is that the rider lacks control over where the innertube goes. Every time the boat turns, the innertube tends to continue in its original direction, unless pulled in a different direction. A large body of water is required to make turns safely at high-speed. If such is not the case, the innertube might approach the shore, or undesirable debris. In addition, this sport remains unchallenging compared to similar water sports, where the rider can steer.

There has been some interest in making steerable innertubes. For example, in U.S. Pat. No. 5,819,680, a steerable towcraft is taught. The floating device is triangular, which does not make it exactly a ski biscuit. The rider can pull on a steering line with respect to the towline, which rotates the floating device. A fin that is fixedly attached to the underside of the floating device converts the rotation into changed direction.

A problem in this invention is that steering can be performed only when there is active towing by the boat, i.e. with the towline being taut. When the towline is slack, there is no steering control. Plus, it is not adaptable to existing ski biscuits.

Moreover, as per U.S. Pat. No. 5,899,782 to Martin, a flotation device is provided that can be towed behind a speeding boat, and can change direction. The rider pulls on handle with respect to the taut towline, which rotates the flotation device with respect to the direction that it is being pulled. Again, a fin-like apparatus provided under the flotation device converts this rotation into a changed direction of motion for the flotation device.

This invention has the same problem of lack of steering control when the towline is not taut. In addition, the handle may fall into the water, in which case the rider loses control.

BRIEF SUMMARY OF THE INVENTION

The present invention overcomes these problems and limitations of the prior art.

Generally, the present invention provides an innertube accessory that facilitates towing an innertube by a boat. The accessory is a device that includes a shell for receiving the innertube, that is also suitable for being towed by the boat. While the innertube provides flotation, a rider of the innertube can also steer the device. The rider steers by operating a rudder of the device, that controls pivoting of a rudder fin relative to the shell.

The rudder is operated independently of the towline, and cannot fall into the water, which makes the device of the invention safer to use. The foregoing and other features and advantages of the invention will become more readily apparent from the following detailed description of a preferred embodiment which proceeds with reference to the drawings.

DETAILED DESCRIPTION OF THE PREFERRED EMBODIMENT(S)

As has been mentioned, the present invention provides a ski biscuit accessory. The accessory is a device for facilitating towing an innertube on a surface of water by a pulling watercraft traveling in a boat direction. The device is steerable by a rider riding in the innertube, for attaining a second direction different from the boat direction.

Figure 1:
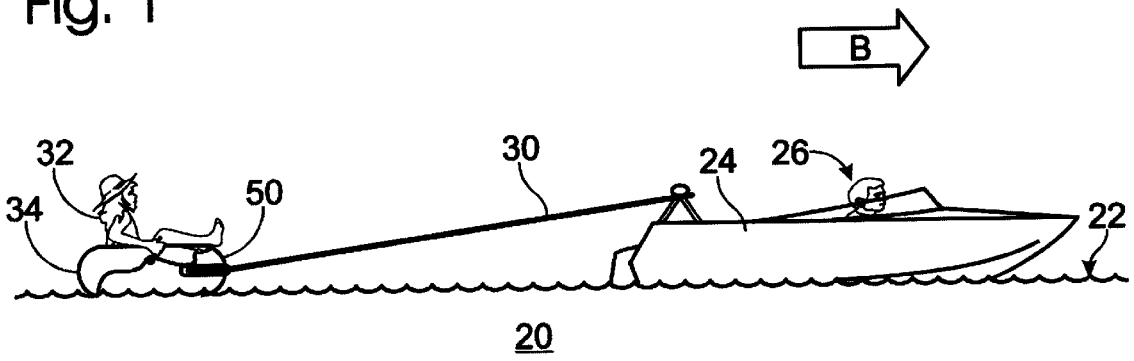
FIG. 1 is a side view showing use of a device of the present invention.

The invention is now described with reference to FIG. 1. A body of water 20 has a surface 22, on which the boat 24 is pilot and by a driver 26 along a boat direction B. The boat is towing, via a towline 30, a rider 32. Rider 32 rides on an innertube 34, a.k.a. ski biscuit 34. Innertube 34 is attached to accessory 50, made according to the present invention.

Figure 2:
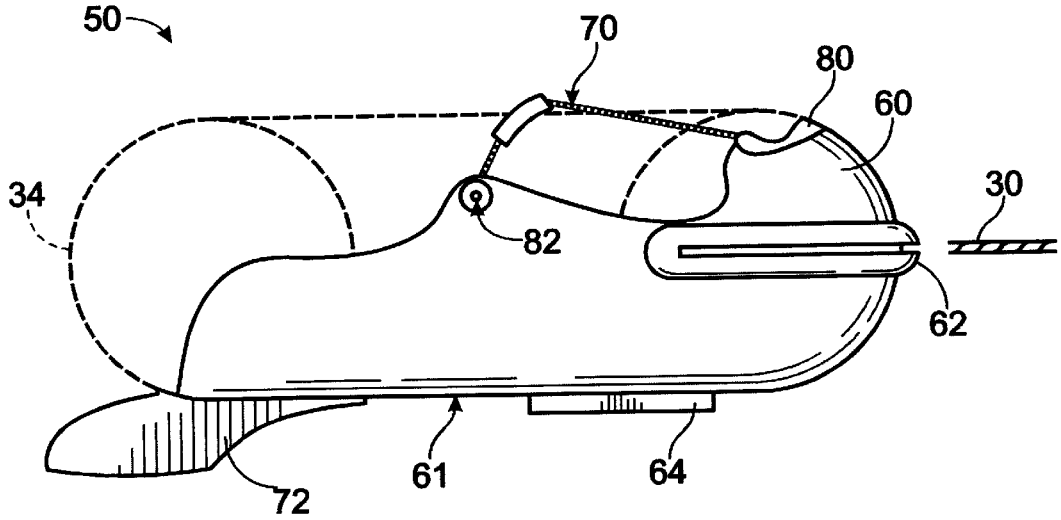
FIG. 2 is a side view of a device made according to the present invention, and also showing in dashed lines the placement of a ski biscuit.
Figure 3:
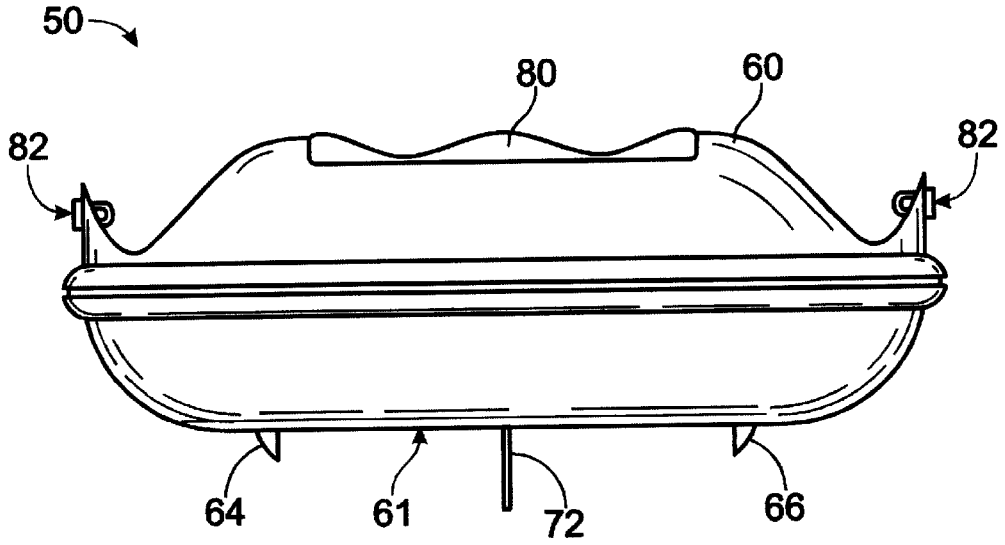
FIG. 3 is a front view of the device of FIG. 2, without the ski biscuit, without the steering rope, and with the removed from the track.

Referring now to FIGS. 2 and 3, the preferred embodiment of accessory 50 of the invention is described in more detail. Accessory 50 includes a shell 60 for receiving innertube 34, and for riding substantially on the water surface. Shell 60 is preferably shaped to present low drag, and its underside 61 is slick. The whole shell 60 is preferably semi rigid and lightweight. It can be made of the suitable material, such as fiberglass or high density plastic, and be 3/16" to 1/4" thick. It can be built using injection molding, or using sheet plastic over a vacuum form mold. The sheet is heated and formed over a mold via vacuum holes in the mold.

Shell 60 is also for coupling to the towline 30, for being towed by the boat. The preferred embodiment of accessory 50 further includes a track and trolley system, which is described below. The track 62 is attached to a front side of the shell 60.

Device 50 preferably further includes skegs 64, 66 also known as fins, fixedly attached to the underside of the shell 60. Only skeg 64 is seen in FIG. 2; skeg 66 is obscured by skeg 64. These skegs 64, 66 provide stability in the chosen direction, especially for when the device of the invention is running parallel to the pulling boat, but not behind it. If not provided as stand out skegs, the shell 60 can have raised surfaces for providing a similar guiding effect. When using standing out skegs such as those shown, a kit can come with replaceable skegs of different sizes, for different performances at different speeds.

Device 50 of the invention further includes a rudder 70, and at least one rudder fin 72. Rudder fin 72 is attached pivotably to shell 60, and preferably at the rear. It is to be under the water surface at least in part. Rudder 70 is operable by the rider, for pivoting rudder fin 72 relative to shell 60. This will cause rudder 70 to steer shell 60 by rudder fin 72 engaging the water.

The preferred embodiment of device 50 further includes a dash 80 and two eyeholes 82 for the rudder, as a seen below.

Figure 4:
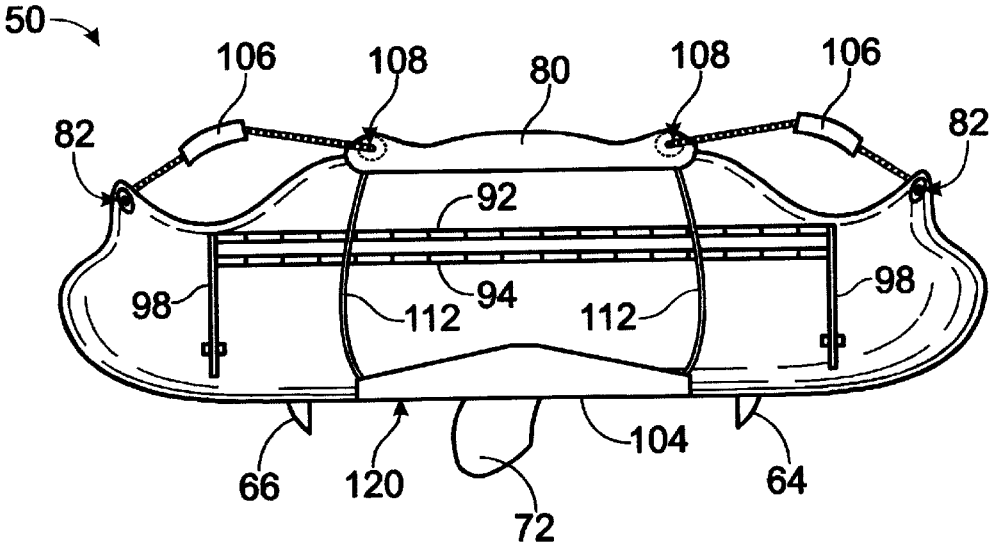
FIG. 4 is a rear view of the device of FIG. 2.

FIG. 4 is a view of device 50 as it appears before inserting and attaching an innertube. Two aluminum strips 92, 94, accommodate series of screws support the track (not seen in FIG. 5) that is on the outside.

Two sets of straps 98 are attached to the inside of shell 60. They are preferably attached by the aforementioned strips 92, 94. The straps are for attaching the innertube to shell 60. The straps can terminate in belt-like buckles, or use Velcro. The straps can either go around the innertube, or attach to handles of the innertube. The straps can be adjustable to accommodate various sizes innertubes.

Figure 5:
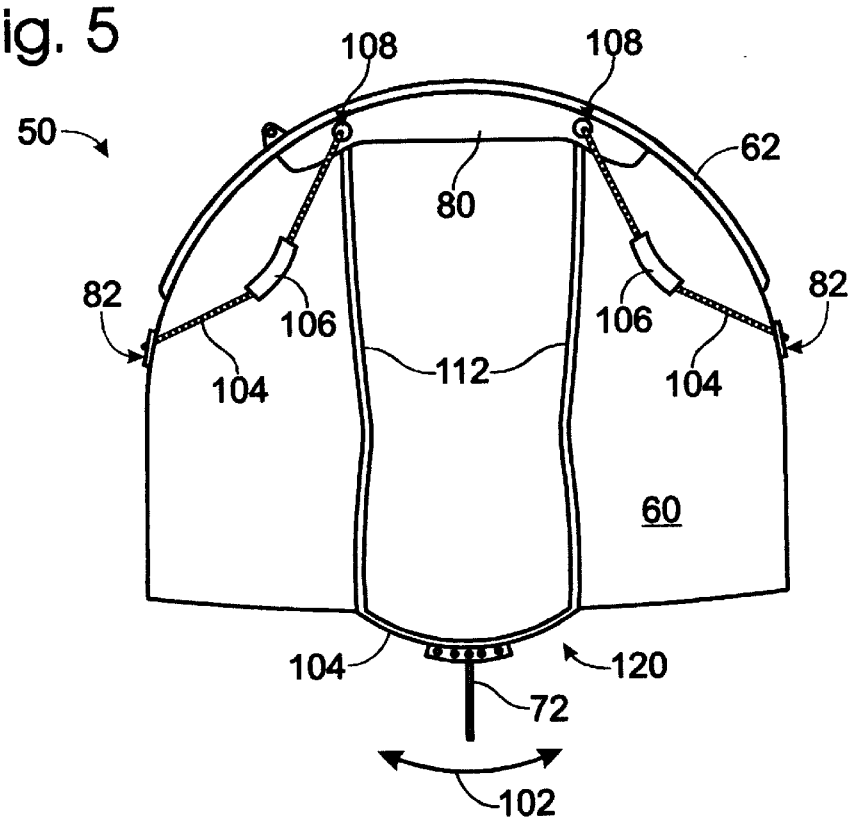
FIG. 5 is a top view of the device of FIG. 2, plus the steering rope.

The rudder 70 of the invention is now described in more detail, referring to FIG. 4 and also to FIG. 5. A rudder according to the invention is any mechanism that will rotate rudder fin 72 with respect to shell 60 according to arc 102.

The preferred rudder includes at least one steering rope 104 that coupled with rudder fin 72, and is operable by the rider to pivot the rudder fin 72. As seen in FIG. 4 and in FIG. 5, steering rope 104 terminates at the two eyeholes 82.

Preferably steering rope 104 includes steering handles 106. These can be made from plastic tubing or foam rubber around steering rope 104. They are preferably made from foam rubber tubes with a plastic tube in the core for rigidity. These left and right steering handles 106 serve both to steer the craft, and also to maintain a constant positive grip on the vessel. The steering handles are held in place on steering rope 104 via knots tied in steering rope 104 at each end of steering handles 106. Then steering rope 104 passes through two eyeholes 108 provided in dash 80.

Device 50 preferably further includes tubes 112. Steering rope 104 runs through tubes 112 at least in part. Tubes 112 can be made from nylon, and be mounted to dash 80 and to a rudder station 120. The nylon tubes can be allowed to lay along the floor of the shell from the dash to the rudder station. Alternatively, they may also be inlayed into the fiberglass, when the shell is produced. The nylon tubes protect the steering rope from being pinched down by the weight of the ski biscuit during operation.

Steering rope 104 continues through rudder station 120. Steering rope 104 is engaged with rudder fin 72. Engagement can be by threading through the rear portion of rudder station 120. A knot can be tied and recessed into a receiving hole, which keeps the rope fixed to the controlled end of the rudder.

As the rider pulls on the left steering handle, the rudder will turn the craft to the left. The opposite is true if the rider pulls on the right handle. Whichever handle is pulled, the opposite handle must be relieved, as steering rope 104 is continuous in this embodiments. Other embodiments can have a plurality of ropes, or levers, etc.

Figure 6:
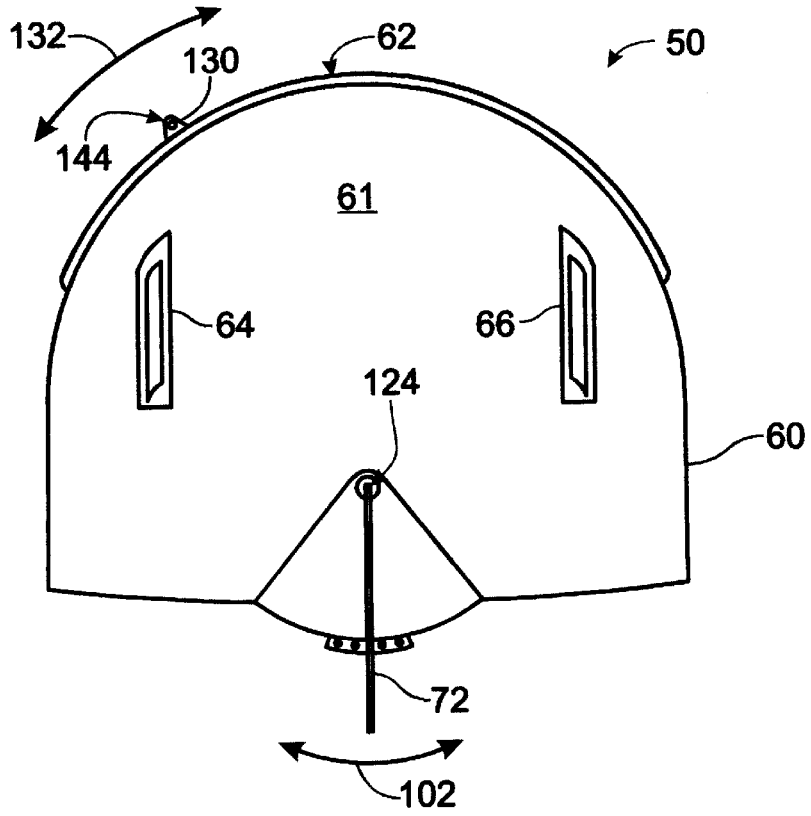
FIG. 6 is a bottom view of the device of FIG. 2.

Referring now to FIG. 6, underside 61 of shell 60 is seen. A rudder pivot point 124 is the center of arc 102.

A trolley 130 is used for attaching to the towline. Trolley 130 has an opening 144 for tying therethrough the towline. Trolley 130 is movably engaged in track 62. As such, trolley 130 can move freely along arc 132, depending on where device 50 is with respect to the towing boat. It will be appreciated that, While the combination of rudder fin 72 and skegs 64, 66, may move around device 50 with respect to the towing boat, the fact that the trolley 130 is free to move will keep device 50 from being forced to return behind the boat.

Figure 7:
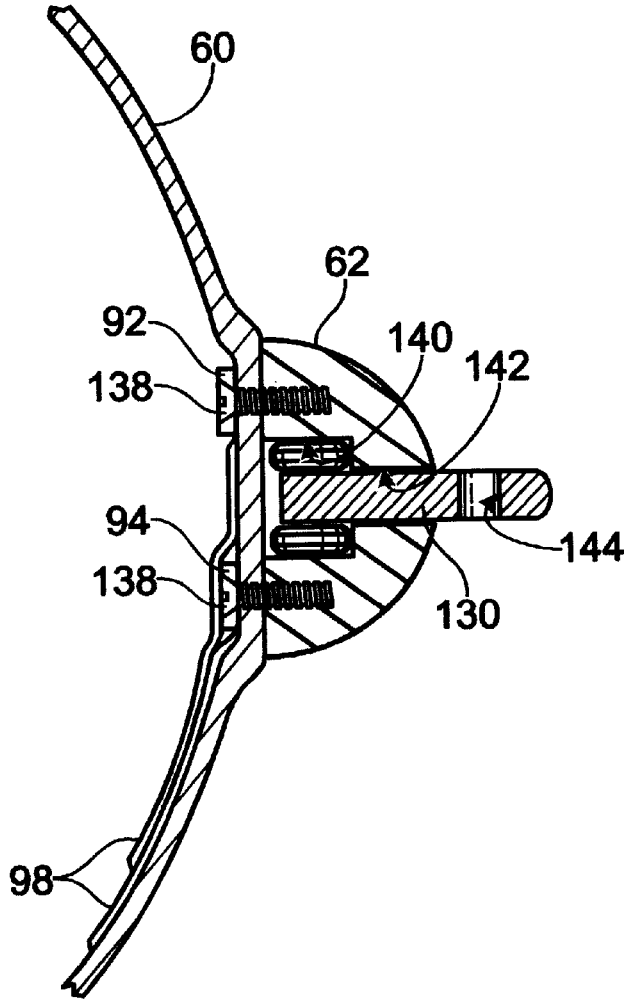
FIG. 7 is a section view of a track and trolley as it is attached to the body of the device of FIG. 2
Figure 8:
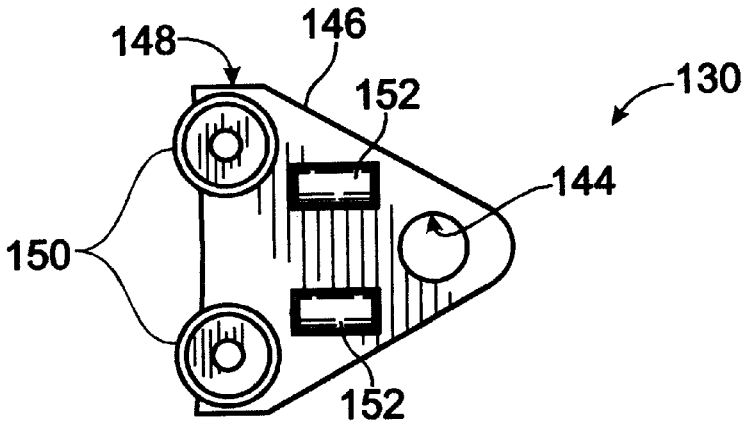
FIG. 8 is a bottom/perspective view of a trolley of FIG. 7.

Referring now to FIGS. 7 and 8, the track and trolley system are described in more detail. Track 62 defines an oblong channel that extends horizontally along the front side of shell 60. The channel has a wide portion 140, and a constricted neck portion 142. Trolley 130 is movable within the channel.

Track 62 can be made from plastic such as ultra high molecular weight ("uhmw") plastic. It can be made starting from round stalk having a 3" radius at 180°, with rounded ends. In the event that the shell is produced via injection molding, the track and shell can be produced as a single component. Track 62 is attached to shell 60 by screws 138, that go through strips 92, 94.

Seen better in FIG. 8, trolley 130 has a body 146, that can be ½" thick, and can be made from umhw plastic. Body 130 has an expanded portion 148, that is confined by the constricted neck portion 142 of the channel into the wide portion of the channel. Trolly 130 includes bearings at the expanded portion 148, for rolling within the wide channel portion 140. The bearings can have ¾" outer diameter and ¼" inner diameter. The bearings are preferably made from a rust resistant material, such as stainless steel. Trolley 130 also includes rollers 152, such as nylon rollers, for rolling within the constricted neck portion 142 of the channel. The bearings and the rollers are supported by shafts and pins.

Figure 9:
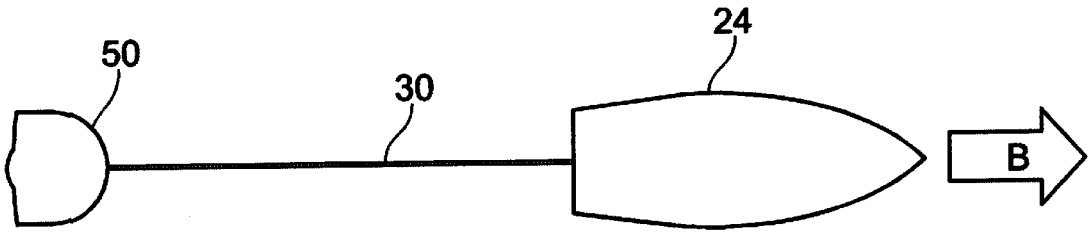
FIG. 9 is a top view of FIG. 1 with the ski biscuit being towed along the center line of the boat.
Figure 10:
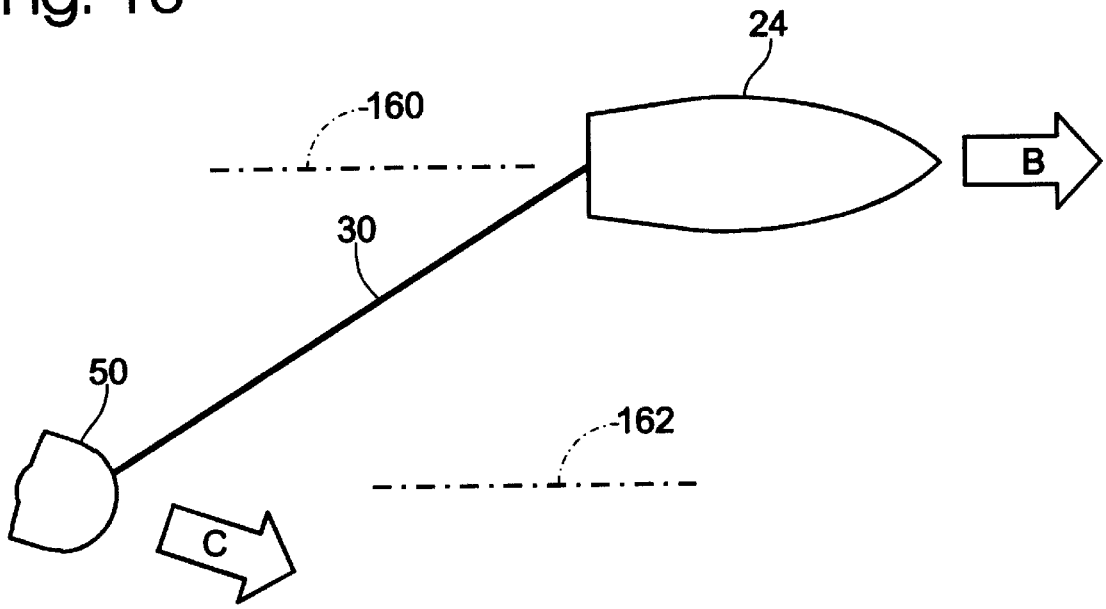
FIG. 10 is a view occurring after FIG. 9, where the rider of the device of the invention has steered to the right.

Referring now to FIGS. 4, 5, 9 and 10, a steering method of the invention is described As seen in FIG. 9, if unsteered, an innertube connected with device 50 of the invention ordinarily is towed behind pulling watercraft 24, and in the same direction B. The method of the invention is for a rider riding in the innertube to steer the innertube to a direction C different from B.

The method is for the innertube rider to pivot a rudder fin 52 of device 50 with respect to shell 60. Rudder fin 52, being under water surface 22, steers shell 60 by engaging water 20.

Preferably pivoting is accomplished by operating a rudder 70 that is coupled with rudder fin 72. Preferably, where the rudder uses a steering rope, operating the rudder is performed by pulling on the steering rope with respect to the shell.

After steering, device 50 will have been placed to the right side of line 160, which is also the centerline of boat 24. Then the rider can adjust the angle of steering, and end up being towed along a line 162, parallel to line 160, and in the same direction. The rider can experiment switching positions according to their comfort level.

Another advantage of the invention is that it can be used with an existing ski biscuit. A user does not need to buy a new ski biscuit, or adapt an old one.

A person skilled in the art will be able to practice the present invention in view of the present description, where numerous details have been set forth in order to provide a more thorough understanding of the invention. In other instances, well-known features have not been described in detail in order not to obscure unnecessarily the invention.

While the invention has been disclosed in its preferred form, the specific embodiments thereof as disclosed and illustrated herein are not to be considered in a limiting sense. Indeed, it should be readily apparent to those skilled in the art in view of the present description that the invention can be modified in numerous ways. Applicant regards the subject matter of the invention to include all combinations and subcombinations of the various elements, features, functions and/or properties disclosed herein. The following claims define certain combinations and subcombinations, which are regarded as novel and non-obvious. Additional claims for other combinations and subcombinations of features, functions, elements and/or properties may be presented in this or a related application for patent. Such additional claims are also regarded as included within the subject matter of applicant's invention irrespectively of whether they are broader, narrower, or equal in scope to the original claims.

The invention claimed is:

1. A device for facilitating towing an innertube on a surface of water by a pulling watercraft traveling in a boat direction, the device steerable by a rider riding in the innertube for attaining a second direction different from the boat direction, the device comprising:

a shell for receiving the innertube, and for coupling to the pulling watercraft for riding substantially on the water surface;

at least one rudder fin attached pivotably to an underside of the shell for being under the water surface at least in part;

a rudder operable by the rider for pivoting the rudder fin relative to the shell, the rudder thereby steering the shell by the rudder fin engaging the water, wherein the rudder includes at least one steering rope coupled with the rudder fin and operable by the rider; and at least one tube, and wherein the steering rope runs through the tube at least in part.

2. The device of claim 1, wherein the device is for coupling to the pulling watercraft via a towline, and wherein the device further comprises:

a track attached to a front side of the shell; and a trolley coupled with and moveable along the track for attaching to the towline.

3. The device of claim 1, wherein the steering rope includes at least one handle.

4. The device of claim 3, wherein the device is for coupling to the pulling watercraft via a towline, and wherein the device further comprises:

a track attached to a front side of the shell; and a trolley coupled with and moveable along the track for attaching to the towline.

5. A device for facilitating towing an innertube on a surface of water by a pulling watercraft traveling in a boat direction, the device steerable by a rider riding in the innertube for attaining a second direction different from the boat direction, the device comprising:

a shell for receiving the innertube, and for coupling to the pulling watercraft for riding substantially on the water surface;

at least one rudder fin attached pivotably to an underside of the shell for being under the water surface at least in part; and a rudder operable by the rider for pivoting the rudder fin relative to the shell, the rudder thereby steering the shell by the rudder fin engaging the water, wherein the device is for coupling to the pulling watercraft via a towline, wherein the device further comprises:

a track attached to a front side of the shell; and a trolley coupled with and moveable along the track for attaching to the towline; wherein:

the track includes a channel with a wide portion and a constricted neck portion; and the trolley includes an expanded portion that is contained within the wide portion of the channel by the constricted neck portion of the channel.

6. The device of claim 5, wherein the trolley further includes bearings at the expanded portion for rolling within the wide portion of the channel.

7. The device of claim 5, wherein the trolley further includes at least one roller for rolling within the constricted neck portion of the channel.

* * * * *